US011678783B2

(12) United States Patent
Gao

(10) Patent No.: US 11,678,783 B2
(45) Date of Patent: Jun. 20, 2023

(54) CLEANING BASE STATION AND CLEANING ROBOT SYSTEM

(71) Applicant: SHENZHEN FLY RODENT DYNAMICS INTELLIGENT TECHNOLOGY CO., LTD., Shenzhen (CN)

(72) Inventor: Zhexin Gao, Shenzhen (CN)

(73) Assignee: SHENZHEN FLY RODENT DYNAMICS INTELLIGENT TECHNOLOGY CO., LTD., Shenzhen (CN)

( * ) Notice: Subject to any disclaimer, the term of this patent is extended or adjusted under 35 U.S.C. 154(b) by 277 days.

(21) Appl. No.: 17/166,085

(22) Filed: Feb. 3, 2021

(65) Prior Publication Data

US 2021/0369072 A1 Dec. 2, 2021

(30) Foreign Application Priority Data

May 29, 2020 (CN) ..... 202020946850.1

(51) Int. Cl.
*A47L 11/40* (2006.01)
*B08B 7/02* (2006.01)
(Continued)

(52) U.S. Cl.
CPC ..... *A47L 11/4027* (2013.01); *A47L 9/106* (2013.01); *A47L 9/2873* (2013.01); *B08B 7/02* (2013.01);
(Continued)

(58) Field of Classification Search
CPC .... A47L 11/4027; A47L 9/106; A47L 9/2873; A47L 2201/022; A47L 2201/028; B08B 7/02
See application file for complete search history.

(56) References Cited

U.S. PATENT DOCUMENTS 9,462,920 B1 * 10/2016 Morin ..... A47L 9/2842
2020/0187736 A1 * 6/2020 Jeong ..... A47L 9/2873
2021/0369072 A1 * 12/2021 Gao ..... A47L 9/2873

FOREIGN PATENT DOCUMENTS

CN 2662818 Y 12/2004
CN 201036536 Y 3/2008
(Continued)

OTHER PUBLICATIONS

CN-110115550-A English Machine Translation (Year: 2019).*
(Continued)

*Primary Examiner* — Marc Carlson
(74) *Attorney, Agent, or Firm* — IP & T Group LLP

(57) ABSTRACT

The present disclosure discloses a cleaning base station. The cleaning base station includes a base and a vibration device. The vibration device includes a driving mechanism and a cleaning element. The driving mechanism is fixed to the base. The cleaning element is connected to the driving mechanism. The cleaning element is configured to contact a part-to-be-cleaned of a cleaning robot. The driving mechanism drives the cleaning element to vibrate so as to clean the part-to-be-cleaned of the cleaning robot. The present disclosure also discloses a cleaning robot system using the cleaning base station described above. The present disclosure has the advantages of reducing a user's burden of manual cleaning and avoiding contamination of a floor surface by the part-to-be-cleaned of the cleaning robot.

16 Claims, 6 Drawing Sheets

(51) Int. Cl.
*A47L 9/10* (2006.01)
*A47L 9/28* (2006.01)

(52) U.S. Cl.
CPC ... *A47L 2201/022* (2013.01); *A47L 2201/028* (2013.01)

(56) References Cited

FOREIGN PATENT DOCUMENTS

| | | | | | |
|---|---|---|---|---|---|
| CN | 201271218 | Y | | 7/2009 | |
| CN | 103462555 | A | | 12/2013 | |
| CN | 109171581 | A | | 1/2019 | |
| CN | 110115550 | A | * | 8/2019 | |
| CN | 110115550 | A | | 8/2019 | |
| EP | 0860554 | A2 | | 8/1998 | |
| JP | 2018027305 | A | * | 2/2018 | ..... A47L 11/24 |
| KR | 20090061461 | A | * | 6/2009 | |
| KR | 20210004506 | A | * | 1/2021 | |
| KR | 20210027809 | A | * | 3/2021 | |
| WO | WO-2018107465 | A1 | * | 6/2018 | ..... A47L 11/24 |
| WO | WO-2020040603 | A1 | * | 2/2020 | ..... A47L 11/4011 |
| WO | WO-2020224542 | A1 | * | 11/2020 | ..... A47L 1/02 |
| WO | WO-2020262863 | A1 | * | 12/2020 | ..... A47L 5/22 |

OTHER PUBLICATIONS

International Search Report for the International Application No. PCT/CN2020/142472 issued by the International Searching Authority dated Mar. 26, 2021.

Written Opinion for the International Application No. PCT/CN2020/142472 issued by the International Searching Authority dated Mar. 26, 2021.

Notice of Granting Priority Right of Utility Model Patent Right for the Chinese Patent Application No. 202020946850.1 issued by the Chinese Patent Office dated Jul. 28, 2021.

* cited by examiner

CLEANING BASE STATION AND CLEANING ROBOT SYSTEM

CROSS-REFERENCE TO RELATED APPLICATION

The present disclosure claims priority of Chinese patent application with the filing number 202020946850.1 filed on May 29, 2020 with the Chinese Patent Office, and entitled "Cleaning Base Station and Cleaning Robot System", the contents of which are incorporated herein by reference in entirety.

TECHNICAL FIELD

The present disclosure relates to the field of intelligent cleaning, and in particular to a cleaning base station and a cleaning robot system.

Background Art

A cleaning robot, also known as an automatic cleaner, a smart vacuum cleaner, a robotic vacuum cleaner, or the like, is a kind of intelligent household appliances that can automatically complete a floor cleaning operation in a room with certain artificial intelligence. Generally, the cleaning robot sucks debris on a surface to be cleaned into its own dust box by means of brushing and vacuum suction so as to accomplish the function of cleaning the surface to be cleaned. Generally speaking, robots that complete sweeping, vacuuming, and mopping operations are also collectively classified as cleaning robots. With the improvement of living standards in China, cleaning robots have gradually entered millions of families in China.

Prior art cleaning robots clean floor surfaces using cleaning elements such as wipers (or cleaning cloths) or brushes. When the wipers or brushes become dirty, the floor surfaces will be secondarily contaminated. The cleaning elements such as wipers or brushes need to be manually detached and manually cleaned, which tends to result in low cleaning efficiency.

SUMMARY

In one aspect of the present disclosure, a cleaning base station, comprising a base and a vibration device, wherein the vibration device comprises a driving mechanism and a cleaning element, the driving mechanism is fixed to the base, the cleaning element is connected to the driving mechanism, the cleaning element is configured to contact a part-to-be-cleaned of a cleaning robot, and the driving mechanism is configured to drive the cleaning element to vibrate so as to clean the part-to-be-cleaned of the cleaning robot.

In another aspect of the present disclosure, a cleaning system, comprising the cleaning base station as described above, and a cleaning robot.

BRIEF DESCRIPTION OF THE DRAWINGS

In order to more clearly illustrate technical solutions of embodiments of the present disclosure or of the prior art, drawings required for use in the description of the embodiments or the prior art will be described briefly below. It is obvious that the drawings in the following description are illustrative of some embodiments of the present disclosure. It will be understood by those of ordinary skill in the art that other variant forms can also be obtained from these drawings without any inventive effort.

DETAILED DESCRIPTION OF THE EMBODIMENTS

The technical solutions of the embodiments of the present disclosure will be described below clearly with reference to the accompanying drawings of the embodiments of the present disclosure. It is apparent that the embodiments to be described are some, but not all of the embodiments of the present disclosure. All the other embodiments obtained by those of ordinary skill in the art in light of the embodiments of the present disclosure without inventive efforts will fall within the scope of the present disclosure as claimed.

Figure 1:
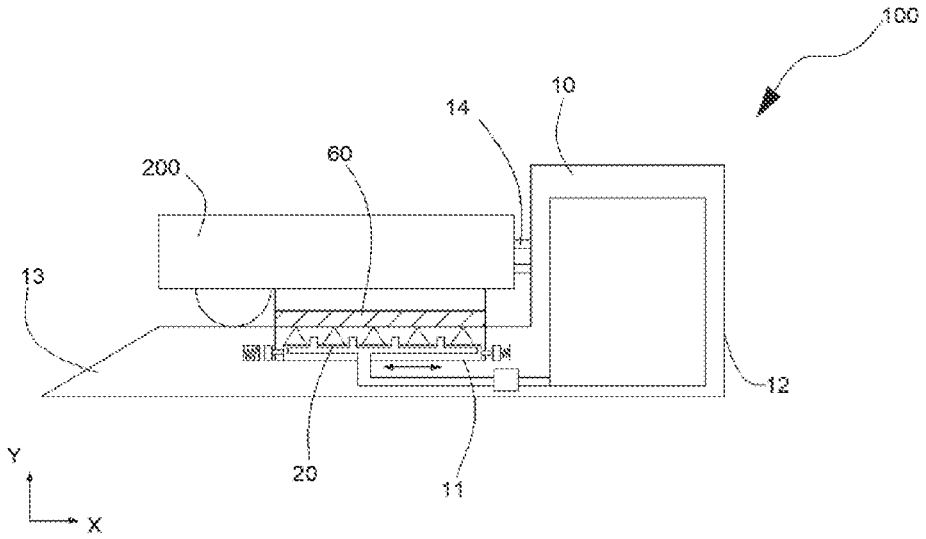
FIG. 1 is a first schematic structural view of a cleaning base station according to an embodiment of the present disclosure.
Figure 2:
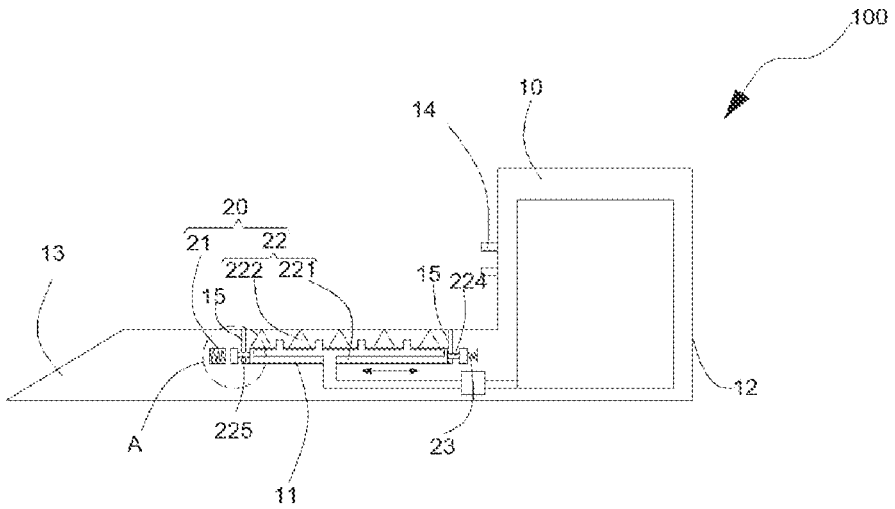
FIG. 2 is a second schematic structural view of a cleaning base station according to an embodiment of the present disclosure.
Figure 3:
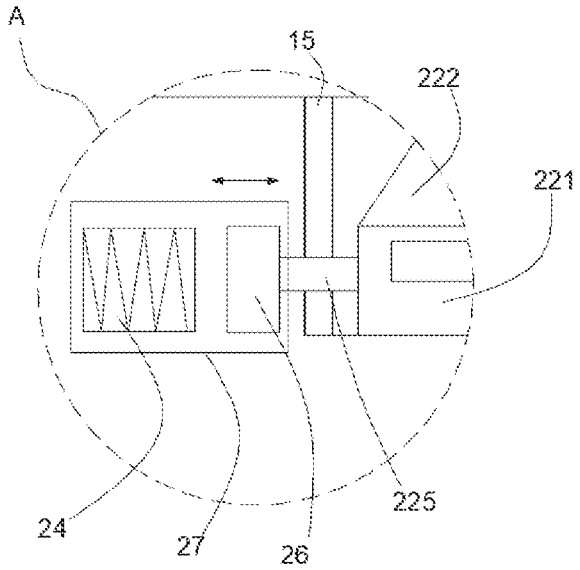
FIG. 3 is an enlarged schematic view of portion A in FIG. 2.

Referring to FIGS. 1, 2, and 3, an embodiment of the present disclosure provides a cleaning base station 100. The cleaning base station 100 includes a base 10 and a vibration device 20. The vibration device 20 includes a driving mechanism 21 and a cleaning element 22. The driving mechanism 21 is fixed to the base 10. The cleaning element 22 is connected to the driving mechanism 21. The cleaning element 22 is configured to contact a part-to-be-cleaned 60 of a cleaning robot 200. The driving mechanism 21 drives the cleaning element 22 to vibrate so as to dean the part-to-be-cleaned 60 of the cleaning robot 200.

Compared with the prior art, the technical solution of the embodiment of the present disclosure has at least the following advantageous effects:

The cleaning base station 100 includes a base 10 and a vibration device 20. The vibration device 20 includes a driving mechanism 21 and a cleaning element 22. The driving mechanism 21 is fixed to the base 10. The cleaning element 22 is connected to the driving mechanism 21. The cleaning element 22 is configured to contact a part-to-be-cleaned 60 of a cleaning robot 200. The driving mechanism 21 drives the cleaning element 22 to vibrate so as to clean the part-to-be-cleaned 60 of the cleaning robot 200. In this way, the part-to-be-cleaned 60 of the cleaning robot 200 can be automatically cleaned by the cleaning base station 100, thereby reducing a user's burden of manual cleaning and avoiding contamination of a floor surface by the part-to-be-cleaned 60 of the cleaning robot 200 to advantageously ensure the cleaning effect of the cleaning robot 200.

It will be understood that the cleaning base station 100 is used in combination with the cleaning robot 200. The cleaning robot 200 may be any one of a floor sweeping robot, an integrated mopping and wiping robot, or a window cleaning robot, or the like, which is not limited herein.

The bottom of the cleaning robot 200 is usually provided with one or more parts selected from wheels, a mopping and wiping member, a side brush, and a middle brush. The above-mentioned parts are usually easily contaminated while the cleaning robot 200 is performing a cleaning process. As a result, the floor surface is easily secondarily contaminated by the cleaning robot 200 during its movement. Conventionally, it is necessary for a user to actively participate in the cleaning and maintenance of the cleaning robot 200 and manually replace and wash the part-to-be-cleaned 60 of the cleaning robot 200. In contrast, the cleaning base station 100 according to an embodiment of the present disclosure can automatically clean the part-to-be-cleaned 60 of the cleaning robot 200, so that the user is advantageously liberated from heavy labor.

The cleaning base station 100 automatically cleans the part-to-be-cleaned 60 of the cleaning robot 200 by means of the vibration device 20. In order to achieve a good cleaning effect, the vibration device 20 may use a cleaning medium such as water, ultrasonic wave, or a cleaning reagent to clean stains in the cleaning process to improve the cleaning effect. Here, a better cleaning effect is achieved by cleaning stains with water, and water for cleaning has relatively low cost. In other embodiments, the cleaning base station 100 may clean the part-to-be-cleaned 60 of the cleaning robot 200 without adding water.

Charging contacts 14 may be arranged on the outer side wall of the base 10. The base 10 supply electric power to the charging contacts 14 by using an external power source or a built-in power source electrically connected to the charging contacts 14. The charging contacts 14 is configured to align with corresponding charging contacts of the cleaning robot 200 to charge the cleaning robot 200. In this way, while the cleaning base station 100 is cleaning the part-to-be-cleaned 60 of the cleaning robot 200 by means of the vibration device 20, the cleaning robot 200 can be charged by the charging contacts 14 to ensure the continuous operability of the cleaning robot 200.

The base 10 includes a platform 12 and a main housing 13 fixedly connected to the platform 12. The platform 12 is configured to support the cleaning robot 200. The vibration device 20 is mounted on the platform 12. The charging contacts 14 is arranged on the main housing 13. The platform 12 is configured to support the cleaning robot 200. The vibration device 20 is mounted on the platform 12 so as to align with the part-to-be-cleaned 60 at the bottom of the cleaning robot 200. The driving mechanism 21 can drive the cleaning element 22 to move relative to the base 10. The cleaning element 22 can contact with and move relative to the part-to-be-cleaned 60 of the cleaning robot 200, so that the cleaning element 22 has the function of scrubbing the surface of the part-to-be-cleaned 60 of the cleaning robot 200. The cleaning element 22 can take away dirt from the surface of the above-mentioned part-to-be-cleaned 60 and can achieve the function of cleaning the surface of the part-to-be-cleaned 60.

The platform 12 may be integrated with the main housing 13, or the platform 12 and the main housing 13 may be detachably connected to each other, which may be flexibly arranged as required.

Referring to FIGS. 1 and 2, further, the cleaning element 22 includes a vibrating member 221 connected to the driving mechanism 21 and a cleaning portion 222 arranged on the vibrating member 221.

In this embodiment, the cleaning element 22 is movably connected to the base 10. The cleaning element 22 is movable relative to the base 10 in a preset direction, thereby allowing the driving mechanism 21 to drive the cleaning element 22 to vibrate relative to the base 10. In an optional embodiment, the cleaning element 22 is mounted on the platform 12 of the base 10. In other embodiments, the cleaning element 22 may be mounted on the main housing 13 of the base 10.

The vibrating member 221 is substantially shaped like a flat plate. In other embodiments, the specific shape of the vibrating member 221 is not limited to the example given above and may be flexibly set according to actual requirements.

In an optional embodiment, the base 10 is provided with two buffer portions 15 spaced apart from each other. The vibrating member 221 is located between the two buffer portions 15. The two buffer portions 15 can absorb a shock exerted on the base 10 by the vibration of the vibrating member 221 and can reduce the noise generated during the operation of the vibration device 20.

Referring to FIGS. 1, 2, and 3, further, the cleaning portion 222 includes any one or a combination of more of bristles, protrusions, or wipers.

Here, the bristles can be hard bristles, or soft bristles, or a combination of hard bristles and soft bristles. When the bristles scrub the cleaning robot 200, the bristles can penetrate deep into the inside of the part-to-be-cleaned 60 of the cleaning robot 200, thereby advantageously improving the cleaning effect.

The protrusion can be in the shape of a strip, a square, a circle, or the like and can be flexibly shaped as required. One or more such protrusions may be provided. When the protrusions scrub the cleaning robot 200, the protrusions can scrub dirt off the surface of the cleaning robot 200. In an optional embodiment, the cleaning element 22 includes a plurality of strip-shaped blades, and a plurality of protrusions are formed by the plurality of strip-shaped blades. Two adjacent strip-shaped blades are arranged with a spacing therebetween. When the two adjacent strip-shaped blades scrub the cleaning robot 200, the scrubbed dirty water and debris can be collected in the spacing between the above two adjacent strip-shaped blades.

When the cleaning portion 222 includes a combination of bristles and protrusions, dirt can be advantageously removed from the surface and inside of the part-to-be-cleaned 60 of the cleaning robot 200, and a better cleaning effect can be advantageously achieved.

The cleaning portion 222 may be detachably connected to the vibrating member 221, so that the cleaning portion 222 can be freely replaced as needed. Alternatively, the cleaning portion 222 may be fixedly connected to the vibrating member 221 by means of integral molding, gluing, or screw connection.

Referring to FIGS. 1, 2, and 3, further, the vibration device 20 further includes an elastic member 23 connected to the base 10. The elastic member 23 is spaced apart from the driving mechanism 21. The vibrating member 221 is connected between the driving mechanism 21 and the elastic member 23. The driving mechanism 21 includes an electromagnetic portion 24. The electromagnetic portion 24 attracts or repels the vibrating member 221 by means of a magnetic force so that the vibrating member 221 drives the vibration of the cleaning portion 222.

In this embodiment, the vibrating member 221 is provided with a first connecting portion 224 and a second connecting portion 225 arranged opposite to the first connecting portion 224. Both the first connecting portion 224 and the second connecting portion 225 are slidably connected to the base 10. The first connecting portion 224 is adjacent to and connected to the elastic member 23, and the second connecting portion 225 is adjacent to and connected to the driving mechanism 21. The driving mechanism 21 includes a main body, an electromagnetic portion 24, and a metal portion 26 arranged opposite to the electromagnetic portion 24. The electromagnetic portion 24 is fixed to the main body 27. The metal portion 26 is slidably connected to the main body 27. The metal portion 26 slides in a direction parallel to a direction in which the vibrating member 221 slides. The metal portion 26 is fixedly connected to the second connecting portion 225 of the vibrating member 221. In other embodiments, the metal portion 26 may be formed on the second connecting portion 225. The metal portion 26 may be replaced with a magnet portion.

In other embodiments, the driving mechanism may include a driving motor and a crank linkage mechanism. The driving motor may drive reciprocation of the vibrating member 221 relative to the base 10 through the crank linkage mechanism to enable vibration of the vibrating member 221 relative to the base 10.

When a magnetic force exerted on the metal portion 26 by the electromagnetic portion 24 increases to a first threshold that is greater than an elastic force exerted on the vibrating member 221 by the elastic member 23, the metal portion 26 drives the vibrating member 221 to move in a direction close to the electromagnetic portion 24. When the magnetic force exerted on the metal portion 26 by the electromagnetic portion 24 is weakened to a second threshold that is smaller than the elastic force exerted on the vibrating member 221 by the elastic member 23, the elastic member 23 drives the vibrating member 221 to move in a direction away from the electromagnetic portion 24. The electromagnetic portion 24 may receive an alternating current to apply an alternating magnetic field to the metal portion 26, so that the vibrating member 221 is driven to vibrate relative to the base 10, and then the cleaning portion 222 vibrates to scrub the part-to-be-cleaned 60 of the cleaning robot 200 in a reciprocating manner.

Figure 6:
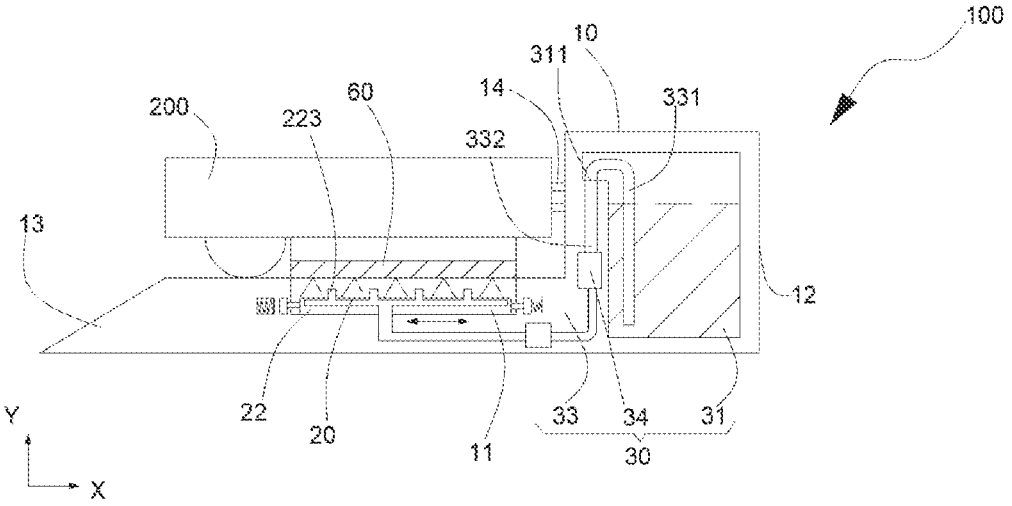
FIG. 6 is a third schematic structural view of a cleaning base station according to an embodiment of the present disclosure.

Referring to FIG. 6, further, the cleaning element 22 is provided with at least one nozzle 223. The at least one nozzle 223 is configured to spray a cleaning medium onto the part-to-be-cleaned 60 of the cleaning robot 200. In this embodiment, the at least one nozzle 223 is arranged on the vibrating member 221. When the driving mechanism 21 drives the vibrating member 221 to vibrate relative to the base 10, the vibrating member 221 drives the cleaning portion 222 to clean the part-to-be-cleaned 60 of the cleaning robot 200. Meanwhile, the at least one nozzle 223 may spray a cleaning medium onto the part-to-be-cleaned 60 of the cleaning robot 200. The cleaning medium may be clear water, water vapor, a dry cleaning agent, or a cleaning liquid at a certain concentration, or the like, which contributes to an improvement of the cleaning effect and to removal of dirt from the surface of the part-to-be-cleaned 60 of the cleaning robot 200.

Figure 4:
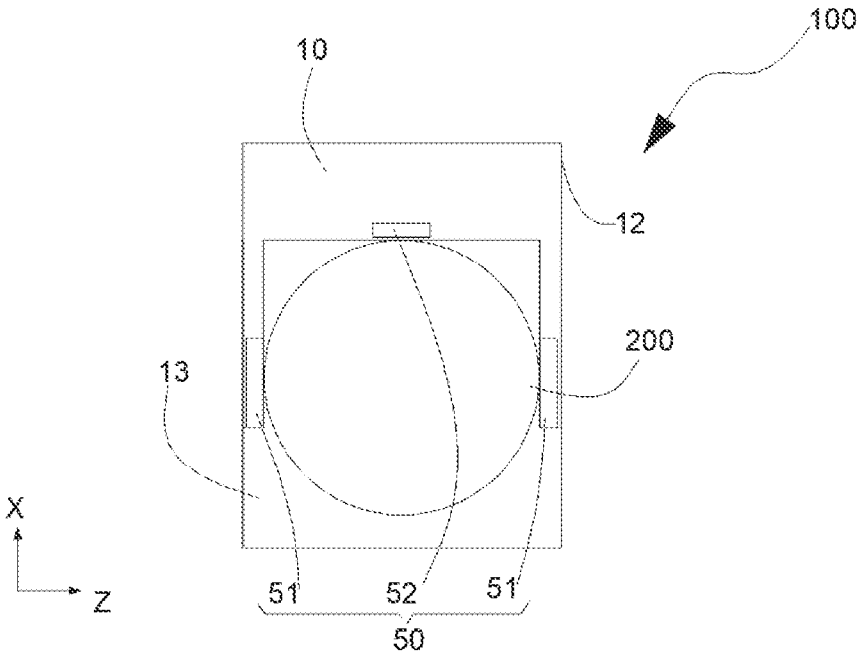
FIG. 4 is a first schematic top view of a cleaning base station according to an embodiment of the present disclosure.

Referring to FIGS. 1 and 4, further, a direction perpendicular to a plane where the platform 12 is located is represented as a first preset direction, and a direction parallel to the plane where the platform 12 is located is represented as a second preset direction. The main housing 13 is further provided with at least one limiting portion 50. The at least one limiting portion 50 is configured to restrict shaking of the cleaning robot 200 in the first preset direction or/and in the second preset direction.

In this embodiment, the first preset direction is marked as a Y direction, and the second preset direction is marked as an X direction (or Z direction), wherein the Y direction is substantially perpendicular to the floor surface, and the X direction (or Z direction) is substantially parallel to the floor surface.

Here, the limiting portion 50 may be a magnet. Thus, the at least one limiting portion 50 may magnetically attract a specific portion (a magnetic member or a metallic member) of the cleaning robot 200. The limiting portion 50 may serve to restrict and stabilize the cleaning robot 200 to prevent the cleaning robot 200 from shaking and affecting the charging effect and the automatic cleaning effect. In other embodiments, the limiting portion 50 may be a limiting groove, and a limiting protrusion which can be engaged in the limiting portion 50 may be provided on the peripheral side of the cleaning robot 200; or the limiting portion 50 may be a limiting protrusion, and a limiting groove in which the limiting portion 50 can be engaged may be provided in the peripheral side of the cleaning robot 200, whereby a restricting and stabilizing effect can also be achieved.

The at least one limiting portion 50 includes two first limiting portions 51 arranged opposite to each other and a second limiting portion 52 located between the two first limiting portions 51. The two first limiting portions 51 and the second limiting portion 52 are distributed in a substantially triangular shape. The two first limiting portions 51 can restrict and stabilize the left and right sides of the cleaning robot 200, and the second limiting portion 52 can restrict and stabilize the front side of the cleaning robot 200, so that the two first limiting portions 51 and the second limiting portion 52 can jointly restrict and stabilize the cleaning robot 200 at multiple points. When the vibration device 20 is cleaning the part-to-be-cleaned 60 of the cleaning robot 200, the cleaning robot 200 can be prevented from violently shaking and being damaged, and the cleaning robot 200 can be prevented from shaking and affecting the charging effect and the automatic cleaning effect.

Referring to FIGS. 5, 6, 7, and 8, further, the base 10 is provided with a dirt collection groove 11. The dirt collection groove 11 faces the bottom of the vibration device 20. The cleaning base station 100 further includes a liquid supply system 30 and a dirt discharge system 40. Both the liquid supply system 30 and the dirt discharge system 40 are mounted on the base 10. The liquid supply system 30 is configured to supply a cleaning medium to the part-to-be-cleaned 60 of the cleaning robot 200 or/and to the cleaning element 22. The dirt discharge system 40 is configured to discharge a liquid or a solid-liquid mixture or a suspension from the dirt collection groove 11.

In this embodiment, the dirt collection groove 11 is formed on the platform 12. The dirt collection groove 11 is formed under the vibration device 20. When the vibration device 20 is scrubbing the part-to-be-cleaned 60 of the cleaning robot 200, the cleaning element 22 leads the scrubbed dirt into the dirt collection groove 11. The liquid supply system 30 may supply clear water, or water vapor, or a mixture of clear water and a cleaning agent, so that the part-to-be-cleaned 60 of the cleaning robot 200 and the cleaning element 22 can be wetted to improve the cleaning effect. The dirt discharge system 40 can discharge a liquid or a solid-liquid mixture or a suspension from the dirt collection groove 11 so as to avoid overflow of dirty water due to excessive collection of dirty water in the dirt collection groove 11.

Figure 5:
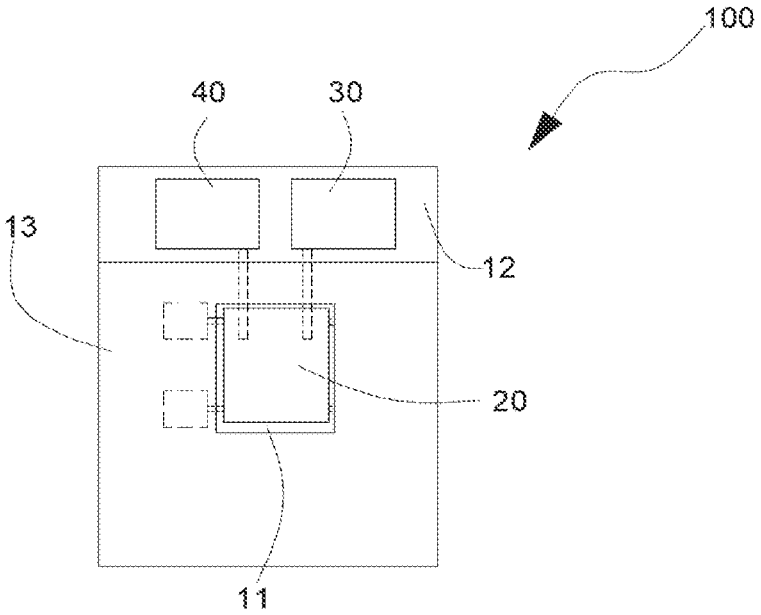
FIG. 5 is a second schematic top view of a cleaning base station according to an embodiment of the present disclosure.

Referring to FIGS. 5 and 6, further, the cleaning element 22 is provided with at least one nozzle 223. The liquid supply system 30 includes a clean water tank 31, a first pipe component 33, and a water pump component 34. The clean water tank 31 is mounted on the base 10. The first pipe component 33 has one end communicating with the clean water tank 31 and the other end communicating with the at least one nozzle 223. The water pump component 34 is mounted on the first pipe component 33 to transport a liquid in the clean water tank 31 to the at least one nozzle 223 through the first pipe component 33.

In this embodiment, the main housing 13 is provided with a containing cavity. The clean water tank 31 is mounted in the containing cavity of the main housing 13. The clean water tank 31 is detachably connected to the main housing 13. A first abutting port 311 is provided in an inner side wall of the clean water tank 31. The first abutting port 311 is adjacent to the top end of the clean water tank 31. The first pipe component 33 includes a first pipe 331 and a second pipe 332. The first pipe 331 is accommodated in the clean water tank 31, and the first pipe 331 is fixedly connected to and communicates with the first abutting port 311 and extends to the bottom of the clean water tank 31. The second pipe 332 is located outside the clean water tank 31, one end of the second pipe 332 is butted to the first abutting port 311 to communicate with the first pipe 331, and the other end of the second pipe 332 is fixedly connected to and communicates with the nozzle 223 component. A sealing ring may be arranged at the connection between the second pipe 332 and the first pipe 331 to prevent leakage of a liquid. The water pump component 34 is mounted on the first pipe 331 or the second pipe 332. The water pump component 34 is configured to pump a liquid from the clean water tank 31 to the nozzle 223 to supply a cleaning liquid to the cleaning element 22 through the at least one nozzle 223. When the liquid in the clean water tank 31 is exhausted, the clean water tank 31 may be taken out of the main housing 13, and clear water or other types of cleaning liquid may be added to the clean water tank 31 again.

The nozzle 223 component includes one or more nozzles 223, which may be flexibly arranged according to actual requirements.

Figure 7:
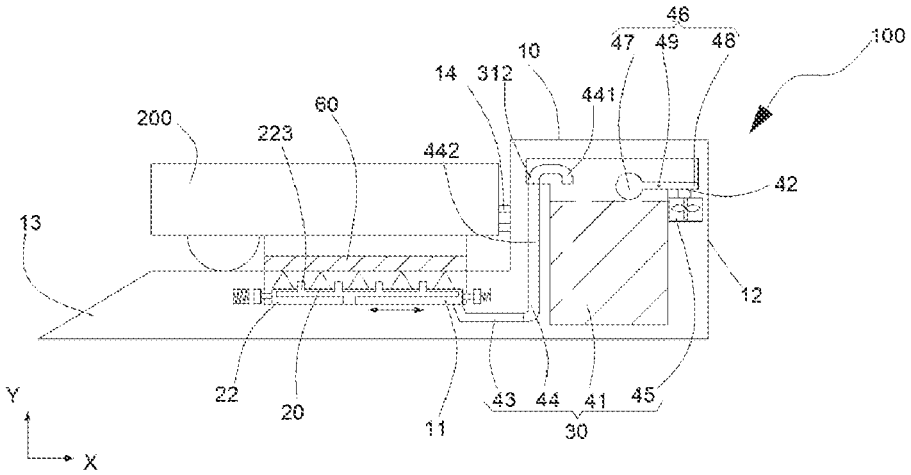
FIG. 7 is a fourth schematic structural view of a cleaning base station according to an embodiment of the present disclosure.
Figure 8:
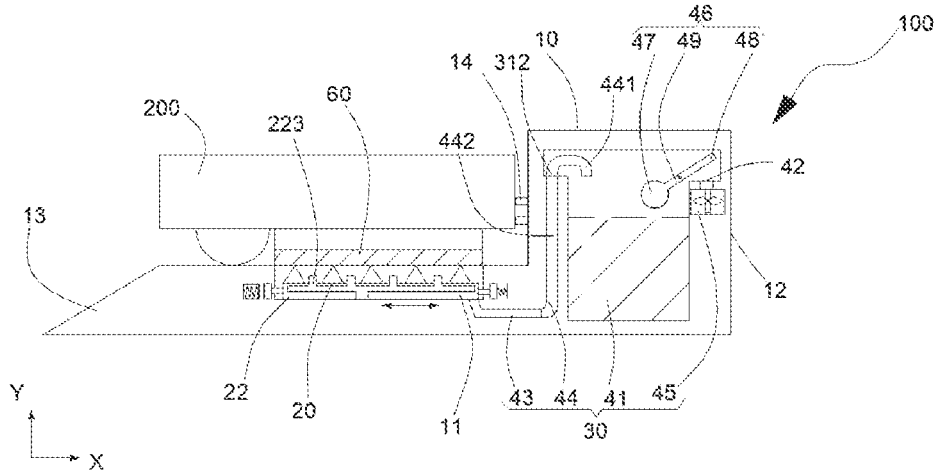
FIG. 8 is a fifth schematic structural view of a cleaning base station according to an embodiment of the present disclosure.

Referring to FIGS. 5, 7, and 8, further, the dirt discharge system 40 includes a dirty water tank 41, a dirty water suction pipe 43, a second pipe component 44, and a pneumatic component 45. Both the dirty water tank 41 and the dirty water suction pipe 43 are mounted on the base 10. The dirty water suction pipe 43 communicates with the dirt collection groove 11. The second pipe component 44 has one end communicating with the dirty water tank 41 and the other end communicating with the dirty water suction pipe 43. The pneumatic component 45 is configured to cause a negative pressure in the dirty water tank 41 to suck dirty water from the dirt collection groove 11 into the dirty water tank 41 through the second pipe component 44.

In this embodiment, the dirty water tank 41 is mounted in the containing cavity of the main housing 13. The dirty water tank 41 and the clean water tank 31 are arranged side by side. A second abutting port 312 is provided in an inner side wall of the dirty water tank 41. The second abutting port 312 is adjacent to the top end of the dirty water tank 41. The second pipe component 44 includes a third pipe 441 and a fourth pipe 442. The third pipe 441 is accommodated in the dirty water tank 41. The third pipe 441 is fixedly connected to and communicates with the second abutting port 312. One end of the third pipe 441 remote from the second abutting port 312 is located at a preset height of the dirty water tank 41 to ensure communication of the third pipe 441 with a gas above the liquid level in the dirty water tank 41. The fourth pipe 442 has one end abutting into the second abutting port 312, and the other end fixedly connected to and communicating with the dirty water suction pipe 43.

An air suction port 42 communicating with the pneumatic component 45 is provided in the inner side wall of the dirty water tank 41. The air suction port 42 is arranged near the top end of the dirty water tank 41 to ensure communication of the air suction port 42 with the gas above the liquid level in the dirty water tank 41. When the pneumatic component 45 is in operation, the pneumatic component 45 sucks the gas from the dirty water tank 41 to cause a negative pressure in the dirty water tank 41, thereby sucking the dirty water from the dirt collection groove 11 to the dirty water tank 41. In this way, it is ensured that the dirty water in the dirt collection groove 11 can be removed in time to avoid overflow of the dirty water from the dirt collection groove 11, thereby meeting the requirement of cleaning the cleaning robot 200 multiple times. The dirty water tank 41 is detachably connected to the main housing 13. When the dirty water in the dirty water tank 41 reaches a certain volume, the user may take out the dirty water tank 41 to empty the dirty water therefrom.

Referring to FIGS. 5, 7, and 8, further, the dirt discharge system 40 further includes a floating ball component 46 located in the dirty water tank 41. The floating ball component 46 includes a floating ball end 47, a cover plate end 48 arranged opposite to the floating ball end 47, and a connecting portion 49 located between the floating ball end 47 and the cover plate end 48. The connecting portion 49 is rotatably connected to the dirty water tank 41. When the dirty water in the dirty water tank 41 reaches a preset volume, the floating ball end 47 floats up following a liquid level in the dirty water tank 41 and drives the cover plate end 48 to cover the air suction port 42.

In this embodiment, both the floating ball end 47 and the cover plate end 48 is rotatable around a center of rotation of the connecting portion 49. The pneumatic component 45 can suck the gas from the dirty water tank 41 through the air suction port 42 so that the dirty water in the dirt collection groove 11 is introduced into the dirty water tank 41 under the action of the negative pressure.

When the liquid level in the dirty water tank 41 is lower than a preset position, the cover plate end 48 is spaced apart from the air suction port 42 to open the air suction port 42 so that the pneumatic component 45 continues sucking air through the air suction port 42. When the liquid level in the dirty water tank 41 rises to the preset position, the floating ball end 47 is pushed by the liquid level upward to the preset position, and thus the floating ball end 47 drives the rotation of the connecting portion 49 so that the cover plate end 48 is lowered to the position of the air suction port 42 to cover the air suction port 42. In this way, the pneumatic component 45 cannot continue sucking air through the air suction port 42, so that the negative pressure in the dirty water tank 41 disappears, and the continued suction of dirty water into the dirty water tank 41 is stopped, thereby preventing outflow of the dirty water due to an excessively high liquid level in the dirty water tank 41.

Figure 9:
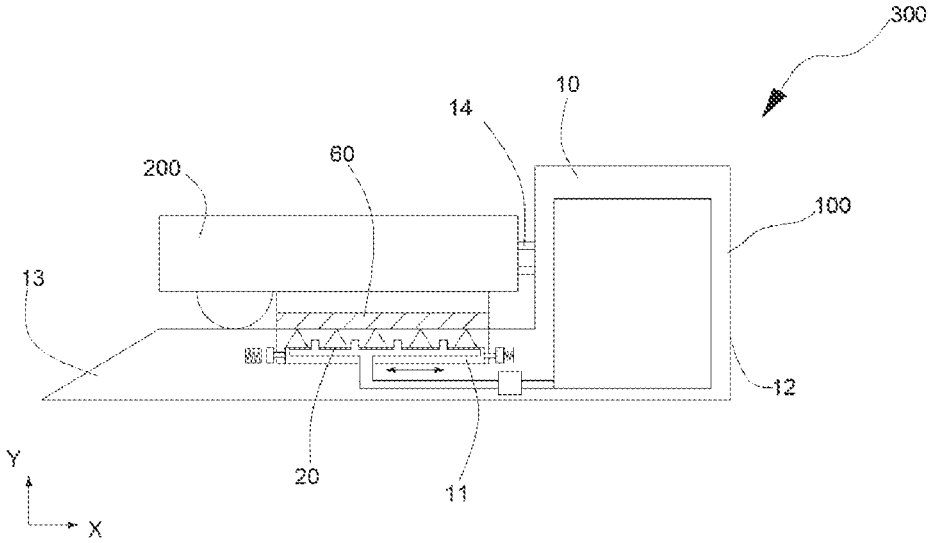
FIG. 9 is a schematic structural view of a cleaning robot system according to an embodiment of the present disclosure.
Figure 10:
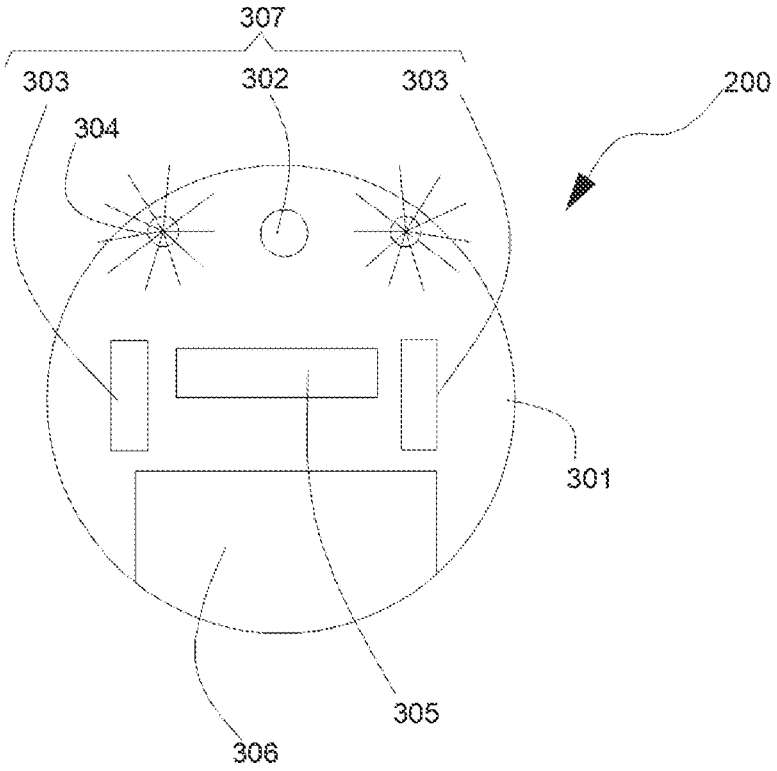
FIG. 10 is a schematic structural view of a cleaning robot according to an embodiment of the present disclosure.

Referring to FIGS. 9 and 10, an embodiment of the present disclosure also provides a cleaning robot system 300. The cleaning robot system 300 includes a cleaning base station 100 as described above and a cleaning robot 200.

The cleaning robot 200 includes a robot body 301. The robot body 301 is constructed in a relatively flat, disc shape. According to the actual situation, the robot body 301 may be constructed in other shapes, for example, constructed in a "D" shape, constructed in a square box shape, constructed in a hemispherical shape, constructed in a pyramid-like shape, constructed in a wedge shape, or the like.

The robot body 301 is equipped with a sensor system (not shown). The sensor system (not shown) can guide the cleaning robot 200 to move onto the cleaning base station 100. The charging contacts 14 on the cleaning base station 100 can align with corresponding charging contacts of the cleaning robot 200 to supply electrical power thereto. Here, the sensor system (not shown) may include one or more of a laser navigation sensor, an inertial navigation sensor, a visual navigation sensor, or an infrared navigation sensor.

A travelling wheel component 307 is mounted at the bottom of the robot body 301. The travelling wheel component 307 is rotatable relative to the robot body 301 in a vertical plane. The travelling wheel component 307 includes a first wheel and a second wheel.

There are at least two second wheels, which are distributed on the left and right sides of the bottom of the robot body 301, respectively, to carry and drive the cleaning robot 200 to move on a surface to be cleaned. The first wheel is mounted at the front or rear portion of the bottom of the robot body 301 and is configured to be distributed in a triangular shape together with the two second wheels to provide more stable support for the movement of the cleaning robot 200 on the surface to be cleaned. The first wheel is an omnidirectional wheel, which allows the cleaning robot 200 to turn more flexibly when moving.

The cleaning robot 200 further includes a side brush component 304 and a middle brush component 305 mounted at the bottom of the robot body 301. The middle brush component 305 includes at least one middle brush. The at least one middle brush may include one or both of a middle bristle brush and a middle rubber brush. The at least one middle brush may be arranged in an accommodating groove provided at the bottom of the robot body 301. The accommodating groove is provided therein with a dust suction port. The dust suction port communicates with a dust collecting box and a dust suction fan, so that dust and debris on the floor surface are stirred up when the middle sweeping bristle brush is rotated, and a suction force is generated by the dust suction fan to suck the dust and debris from the dust suction port into the dust collecting box.

The cleaning robot 200 includes a mopping and wiping component 306. The mopping and wiping component 306 may be in a structural form of a turntable-type wiper, a roller-type wiper, a crawler-type wiper, or a flat-plate-type wiper, or the like. The specific structural form may be flexibly set according to actual requirements.

The part-to-be-cleaned 60 of the cleaning robot 200 may include at least one of the travelling wheel component 307, the middle brush component 305, and the mopping and wiping component 306. When the cleaning robot 200 moves onto the cleaning base station 100, the cleaning base station 100 can clean at least one of the travelling wheel component 307, the middle brush component 305, and the mopping component 306 by using the cleaning device as described above.

In the description of this specification, a reference term such as "one embodiment", "some embodiments", "an example", "a specific example", or "some examples" is described to mean that a specific feature, structure, material, or characteristic described in connection with the embodiment or example is included in at least one embodiment or example of the present disclosure. In this specification, the indicative representation of the above terms does not necessarily refer to the same embodiments or examples. Moreover, the described specific features, structures, materials, or characteristics can be combined in an appropriate manner in any one or more embodiments or examples.

The embodiments described above are not intended to limit the scope of protection of the technical solutions. Any modifications, equivalent alternatives, improvements and so on made within the spirit and principle of the above embodiments are intended to be encompassed within the scope of protection of the technical solutions.

What is claimed is:

1. A cleaning base station, comprising a base and a vibration device, wherein the vibration device comprises a driving mechanism and a cleaning element, the driving mechanism is fixed to the base, the cleaning element is connected to the driving mechanism, the cleaning element is configured to contact a part-to-be-cleaned of a cleaning robot, and the driving mechanism is configured to drive the cleaning element to vibrate so as to clean the part-to-be-cleaned of the cleaning robot;

wherein the cleaning element comprises a vibrating member connected to the driving mechanism and a cleaning portion arranged on the vibrating member;

wherein the vibration device further comprises an elastic member connected to the base, wherein the elastic member is spaced apart from the driving mechanism, the vibrating member is connected between the driving mechanism and the elastic member, and the driving mechanism comprises an electromagnetic portion, wherein the electromagnetic portion attracts or repels the vibrating member by means of a magnetic force, so that the vibrating member drives the cleaning portion to vibrate.

2. The cleaning base station according to claim 1, wherein the cleaning element is provided with at least one nozzle, wherein the at least one nozzle is configured to spray a cleaning medium onto the part-to-be-cleaned of the cleaning robot.

3. The cleaning base station according to claim 1, wherein the base is provided with a dirt collection groove, wherein the dirt collection groove faces a bottom of the vibration device, and the cleaning base station further comprises a liquid supply system and a dirt discharge system, wherein both the liquid supply system and the dirt discharge system are mounted on the base, the liquid supply system is configured to supply a cleaning medium to a part to-be-cleaned of a self-cleaning robot or/and to the cleaning element, and the dirt discharge system is configured to discharge a liquid, a solid-liquid mixture or a suspension from the dirt collection groove.

4. The cleaning base station according to claim 3, wherein the cleaning element is provided with at least one nozzle, and the liquid supply system comprises a clean water tank, a first pipe component, and a water pump component, wherein the clean water tank is mounted on the base, the first pipe component has one end communicating with the clean water tank and the other end communicating with the at least one nozzle, and the water pump component is mounted on the first pipe component to deliver a liquid in the clean water tank to the at least one nozzle through the first pipe component.

5. The cleaning base station according to claim 3, wherein the dirt discharge system comprises a dirty water tank, a dirty water suction pipe, a second pipe component, and a pneumatic component, wherein both the dirty water tank and the dirty water suction pipe are mounted on the base, the dirty water suction pipe communicates with the dirt collection groove, the second pipe component has one end communicating with the dirty water tank and the other end communicating with the dirty water suction pipe, and the pneumatic component is configured to cause a negative pressure in the dirty water tank to suck dirty water from the dirt collection groove into the dirty water tank through the second pipe component.

6. The cleaning base station according to claim 5, wherein an air suction port communicating with the pneumatic component is provided in an inner side wall of the dirty water tank, the dirt discharge system further comprises a floating ball component located in the dirty water tank, and the floating ball component comprises a floating ball end, a cover plate end arranged opposite to the floating ball end, and a connecting portion located between the floating ball end and the cover plate end, wherein the connecting portion is rotatably connected to the dirty water tank, and the floating ball end floats up, following a liquid level in the dirty water tank, and drives the cover plate end to cover the air suction port, when the dirty water in the dirty water tank reaches a preset volume.

7. The cleaning base station according to claim 1, wherein the base comprises a platform and a main housing fixedly connected to the platform, wherein the platform is configured to support the cleaning robot, the vibration device is mounted on the platform, and the main housing is provided with charging contacts, wherein the charging contacts are configured to align with corresponding charging contacts of the cleaning robot, to charge the cleaning robot.

8. The cleaning base station according to claim 7, wherein a direction perpendicular to a plane where the platform is located is represented as a first preset direction, a direction parallel to the plane where the platform is located is represented as a second preset direction, and the main housing is further provided with at least one limiting portion, wherein the at least one limiting portion is configured to restrict shaking of the cleaning robot in the first preset direction or/and in the second preset direction.

9. A cleaning system, comprising the cleaning base station according to claim 1, and a cleaning robot.

10. The cleaning system according to claim 9, wherein the cleaning element is provided with at least one nozzle, wherein the at least one nozzle is configured to spray a cleaning medium onto the part-to-be-cleaned of the cleaning robot.

11. The cleaning system according to claim 9, wherein the base is provided with a dirt collection groove, wherein the dirt collection groove faces a bottom of the vibration device, and the cleaning base station further comprises a liquid supply system and a dirt discharge system, wherein both the liquid supply system and the dirt discharge system are mounted on the base, the liquid supply system is configured to supply a cleaning medium to a part to-be-cleaned of a self-cleaning robot or/and to the cleaning element, and the dirt discharge system is configured to discharge a liquid, a solid-liquid mixture or a suspension from the dirt collection groove.

12. The cleaning system according to claim 11, wherein the cleaning element is provided with at least one nozzle, and the liquid supply system comprises a clean water tank, a first pipe component, and a water pump component, wherein the clean water tank is mounted on the base, the first pipe component has one end communicating with the clean water tank and the other end communicating with the at least one nozzle, and the water pump component is mounted on the first pipe component to deliver a liquid in the clean water tank to the at least one nozzle through the first pipe component.

13. The cleaning system according to claim 11, wherein the dirt discharge system comprises a dirty water tank, a dirty water suction pipe, a second pipe component, and a pneumatic component, wherein both the dirty water tank and the dirty water suction pipe are mounted on the base, the dirty water suction pipe communicates with the dirt collection groove, the second pipe component has one end communicating with the dirty water tank and the other end communicating with the dirty water suction pipe, and the pneumatic component is configured to cause a negative pressure in the dirty water tank to suck dirty water from the dirt collection groove into the dirty water tank through the second pipe component.

14. The cleaning system according to claim 13, wherein an air suction port communicating with the pneumatic component is provided in an inner side wall of the dirty water tank, the dirt discharge system further comprises a floating ball component located in the dirty water tank, and the floating ball component comprises a floating ball end, a cover plate end arranged opposite to the floating ball end, and a connecting portion located between the floating ball end and the cover plate end, wherein the connecting portion is rotatably connected to the dirty water tank, and the floating ball end floats up, following a liquid level in the dirty water tank, and drives the cover plate end to cover the air suction port, when the dirty water in the dirty water tank reaches a preset volume.

15. The cleaning system according to claim 9, wherein the base comprises a platform and a main housing fixedly connected to the platform, wherein the platform is configured to support the cleaning robot, the vibration device is mounted on the platform, and the main housing is provided with charging contacts, wherein the charging contacts are configured to align with corresponding charging contacts of the cleaning robot, to charge the cleaning robot.

16. The cleaning system according to claim 15, wherein a direction perpendicular to a plane where the platform is located is represented as a first preset direction, a direction parallel to the plane where the platform is located is represented as a second preset direction, and the main housing is further provided with at least one limiting portion, wherein the at least one limiting portion is configured to restrict shaking of the cleaning robot in the first preset direction or/and in the second preset direction.

* * * * *